US006593915B1

(12) United States Patent
Swaine et al.

(10) Patent No.: US 6,593,915 B1
(45) Date of Patent: Jul. 15, 2003

(54) SELF-SERVICE TERMINAL

(75) Inventors: Stephen Swaine, Auchterarder (GB); Kenneth A. Nicoll, Dundee (GB); Roderick W. MacLeod, Edinburgh (GB)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/433,131

(22) Filed: Nov. 3, 1999

(30) Foreign Application Priority Data

Nov. 11, 1998 (GB) ..... 9824768

(51) Int. Cl.[7] ..... G09G 5/00
(52) U.S. Cl. ..... 345/173; 248/917; 248/918
(58) Field of Search ..... 361/681, 682; 248/917–925; 345/173, 1.1, 903, 905; 109/2, 24, 24.1, 50, 51, 52

(56) References Cited

U.S. PATENT DOCUMENTS

| | | | | |
|---|---|---|---|---|
| 3,220,556 A | | 11/1965 | Weitzman | |
| 3,889,910 A | * | 6/1975 | Walters | 248/121 |
| 4,142,173 A | | 2/1979 | Gould et al. | |
| 5,240,215 A | * | 8/1993 | Moore | 248/919 |
| 5,405,117 A | * | 4/1995 | Davis | 248/921 |
| 5,595,498 A | | 1/1997 | Jego et al. | |
| 5,842,672 A | * | 12/1998 | Sweere et al. | 248/923 |

FOREIGN PATENT DOCUMENTS

| | | |
|---|---|---|
| DE | 29708096 | 9/1997 |
| EP | 0644511 | 3/1995 |
| FR | 1509735 | 3/1968 |
| FR | 2726401 | 5/1996 |
| WO | 8301868 | 5/1983 |
| WO | 8606856 | 11/1986 |

* cited by examiner

*Primary Examiner*—Dennis-Doon Chow
(74) *Attorney, Agent, or Firm*—Priest & Goldstein PLLC

(57) ABSTRACT

A self-service terminal (10) such as an ATM has a secure enclosure (12) and an external column (14) extending from the secure enclosure (12). The column (14) has a bore (54) for routing electrical conductors and one or more access slots (58) connecting the bore (54) with an external surface (52) of the column (14). A module (40,42) is mounted onto the column (14) using a bracket (50) defining a channel (94) through which the module's electrical conductors (88) are routed. The electrical conductors (88) are routed from the bracket (50) to a central processor within the secure enclosure (12) by means of an access slot (58) and the bore (54). The modules (40,42) are height adjustable relative to the secure enclosure (12).

18 Claims, 4 Drawing Sheets

SELF-SERVICE TERMINAL

BACKGROUND OF THE INVENTION

The invention relates to a self-service terminal (SST), and in particular to a transaction-based SST such as an automated teller machine (ATM).

Conventionally, an ATM has a plurality of modules enclosed within the ATM for protection and security. These modules are used to provide various functions; for example a display module and an encrypting keyboard module are used as a user interface; a receipt printer module is used to provide transaction receipts; other modules include a card reader, a cash dispenser, and such like. In the event of failure of one of these modules, the ATM has to be shut-down, the ATM cover removed, and the malfunctioning module removed and replaced or repaired. This is a time consuming and disruptive process.

SUMMARY OF THE INVENTION

It is an object of the invention to obviate or mitigate the above disadvantage.

According to one aspect of the invention, a self-service terminal is characterized in that the terminal includes at least one external column having a bore, whereby modules may be mounted on the column, and electrical connections from the modules may be routed through the bore.

By virtue of the invention, modules may be secured to the column and electrical connections which link various modules can be routed within the column so that the electrical connections are hidden from view.

Preferably, the at least one column is an elongate, generally upright member; alternatively, the column may be curved (for example, S-shaped) or angular.

Preferably, the column has a circular cross-section; alternatively the column may have a cross-section which is square, elliptical, or a polygon. The cross-section of the column may have a recess. The cross-section of the column may vary (that is, it may not be uniform) throughout the height of the column. The cross-section of the column may be a different shape at different heights.

In one embodiment, a single, substantially vertical column is used, and the column is an elongate cylinder having a circular cross-section.

Preferably, the SST has a base, and the at least one column extends from the base in an upward direction. Preferably, the modules are height adjustable relative to the top of the base.

In one embodiment, the base is an enclosure for housing a central controller to which modules mounted on the column may be electrically connected, and which controls the operations of the mounted modules.

Preferably, the modules are height adjustable relative to the column. Preferably, the column includes one or more access slots, whereby the one or more slots allow electrical conductors to be passed therethrough. Where a plurality of access slots are used, these slots may be spaced apart; however, the combined effect of the spaced slots is to provide many access points in the column.

By virtue of having access slot(s), a module can be located at one of many locations on the column and the electrical conductors which link that module can be easily passed through the access slot (or a portion of the access slot) nearest the module. This arrangement has the advantage that there is a choice of heights at which a module may be located. Thus, a display could be mounted at a lower height on a column in an SST located in an area where the average height of a user is low; whereas the display could be mounted at a higher height on a column in an SST located in an area where the average height of a user is high.

Preferably, the one or more access slots are in the form of one or more apertures. Preferably, each aperture has a resilient seal. Alternatively, where a plurality of access slots are used, each aperture may have an access cover biased to close the aperture so that when the access cover is not in use the aperture is sealed by the access cover to prevent water or dust ingress.

The access slot or slots are conveniently located at the rear of the SST.

In other embodiments, the modules may be fixed relative to the column, but the column may be height adjustable. For example, the column may raised or lowered by means of a jack located within the base. The jack may be controllable by a user of the SST (for example using switches on the front of the SST), so that the column height may be adjusted by each user. The column may have a telescopic construction to allow the column to expand or contract in the upward direction. The column may be movably mounted on the base so that the column may tilted.

According to a second aspect of the invention, a module for use with an SST is characterized in that the module has a fixing bracket adapted for securing to an external column in an SST.

Preferably, the fixing bracket is configured so that it mounts on an external surface of the column. Alternatively, the column may include a recess into which the fixing bracket mounts.

Preferably, the fixing bracket includes a clamp for securing the bracket to the external surface of the column. Preferably, the fixing bracket includes a channel for routing electrical conductors between the module secured to the fixing bracket and an access slot so that the conductors are at least partially hidden from view. Conveniently, the fixing bracket surrounds the access slot used to route the conductors from the module.

Preferably, the module is secured to the fixing bracket by an adjustable joint so that the module can be moved to a desired position and then locked in that position. This allows the position of the module to be adjusted relative to the bracket.

The SST may be an ATM or a kiosk.

BRIEF DESCRIPTION OF THE DRAWINGS

Embodiments of the invention will now be described, by way of example, with reference to the following drawings, in which.

DETAILED DESCRIPTION

Figure 1:
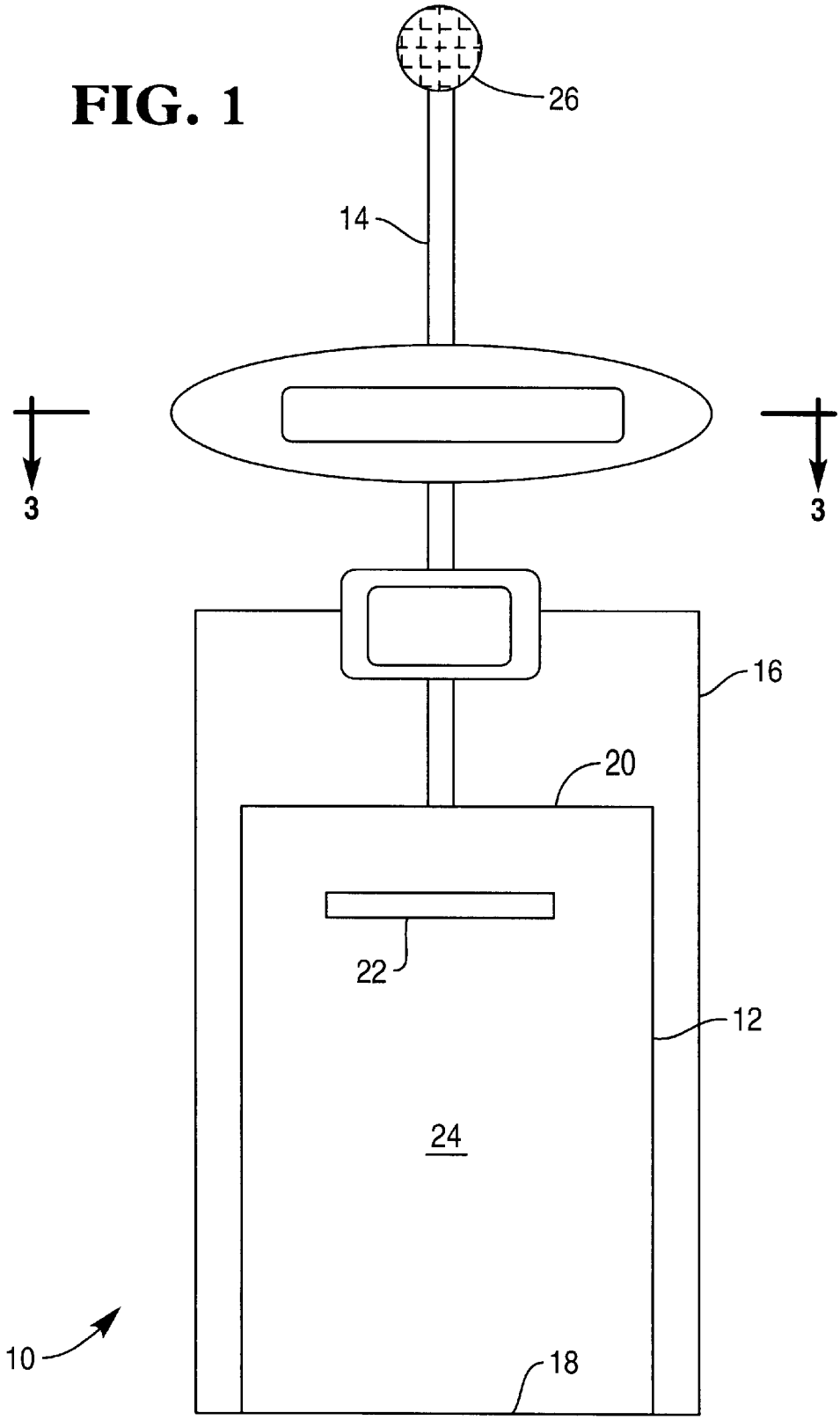
FIG. 1 is a front view of an SST according to one embodiment of the invention.

Referring to FIG. 1, an SST 10 in the form of an ATM is shown. ATM 10 has a base 12 in the form of a high security enclosure from a central area of which a column 14 extends substantially vertically.

A curved sheet 16 extends from the base 18 of the enclosure 12 to approximately 30 cm above the top 20 of the enclosure 12. The sheet 16 curves from the front of the enclosure 12 at the base 18 to near the rear of the enclosure 12 above the top 20. The curved sheet 16 is best shown by FIG. 2 and gives a user of the ATM 10 the impression that the enclosure 12 is not as deep as it actually is.

The enclosure 12 contains a high security safe (not shown) from which currency is dispensed through slot 22 on the front 24 of the enclosure 12. The enclosure 12 also contains a central processor (not shown) for controlling the operation of the ATM 10.

Column 14 is a substantially vertical pole having a cylindrical shape and extending from the top 20 of the enclosure 12 a distance of approximately 1.2 m, so that the ATM 10 is approximately 2.2 m high. The pole 14 extends from a central area between the front 24 and the sheet 16. A sphere 26 is located at the top of the pole 14 and contains a light (not shown). When the ATM 10 is operational the light is illuminated; whereas, when the ATM 10 is out of service, the light is not illuminated, thereby providing a visual indication of the status of the ATM 10 to passers by.

Figure 2:
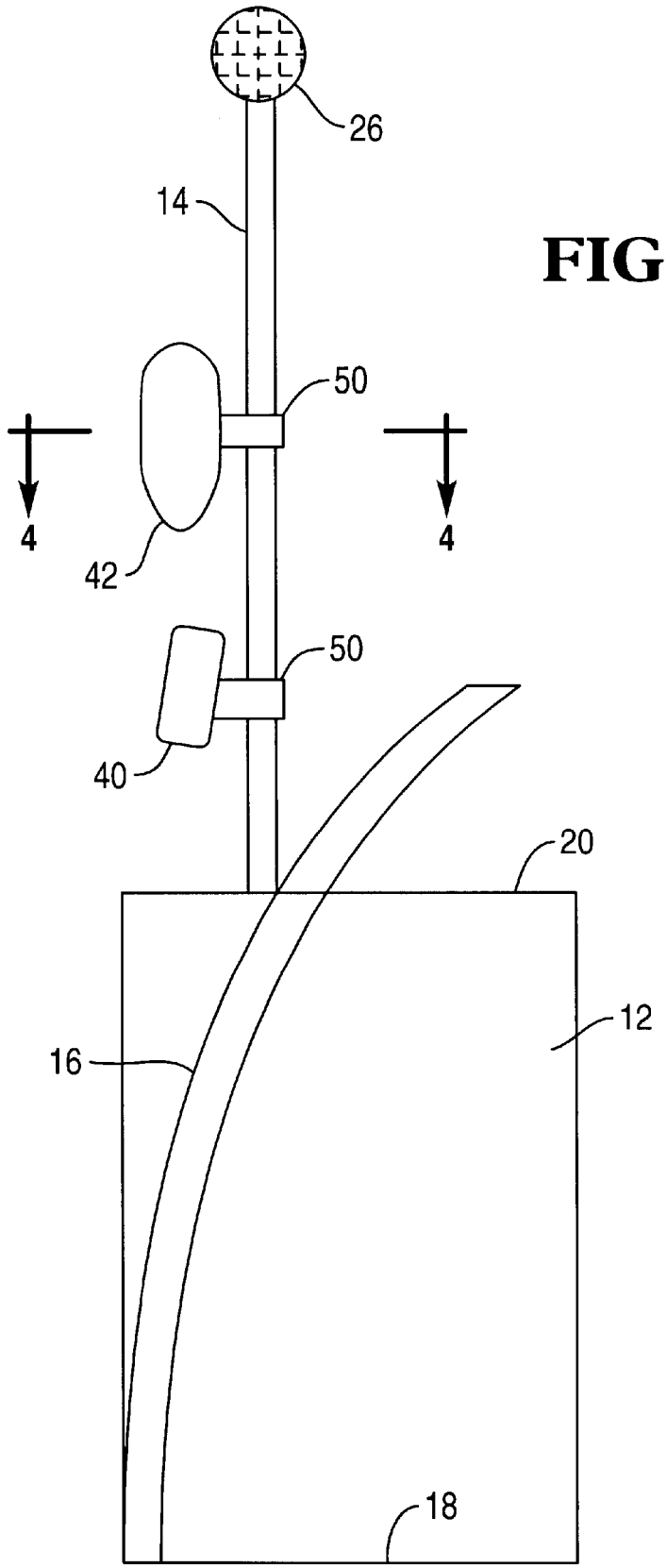
FIG. 2 is a side view of the SST of FIG. 1.

Referring to FIG. 2, a touch screen display module 40 and a human iris recognition module 42 are mounted at different heights on the pole 14 by fixing brackets 50.

Figure 3:
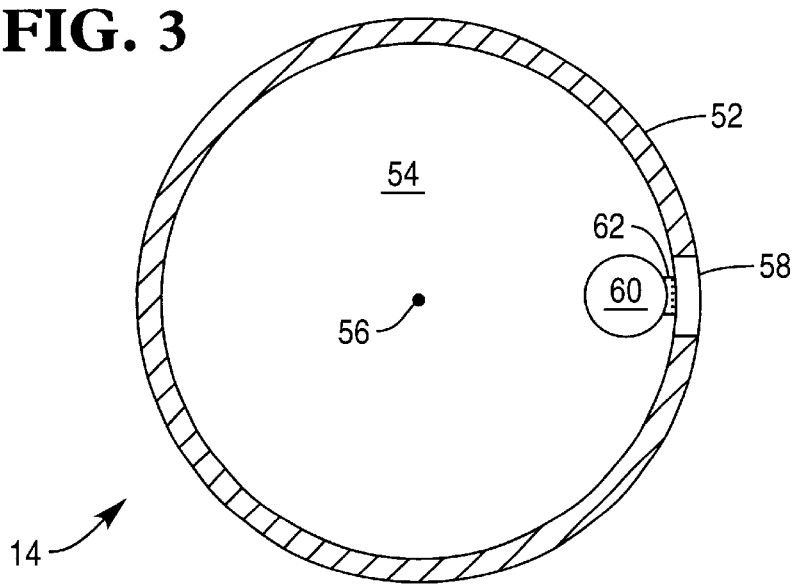
FIG. 3 is cross-sectional plan view of the column of FIG. 1.

FIG. 3 shows a cross-sectional plan view of the pole through line 3—3 on FIGS. 1 and 2. The pole 14 has a circular cross-section and an external surface 52. The pole 14 has a bore 54 co-axial with the external surface 52 so that the bore 54 extends the full height of the pole 14 and has a longitudinal axis 56. Access slots 58 (one of which is shown in FIG. 3) are located at the rear of the pole 14 along a line parallel to the longitudinal axis 56. These slots 58 are typically circular, have a diameter of approximately 1 cm, and are spaced apart (center to center) by approximately 3 cm. Each slot 58 has a circular access cover 60 which is biased to close the slot 58 by an urging mechanism 62 in the form of a spring-mounted arm. If electrical conductors are to be routed through the access slot 58, then the cover 60 is depressed and the conductors are fed through the slot 58. The spring-mounted arm 58 exerts only a relatively weak force so that the insulation on the conductors is not damaged by the bias force. FIG. 3 shows the access cover 60 depressed and pivoted downwards.

Figure 4:
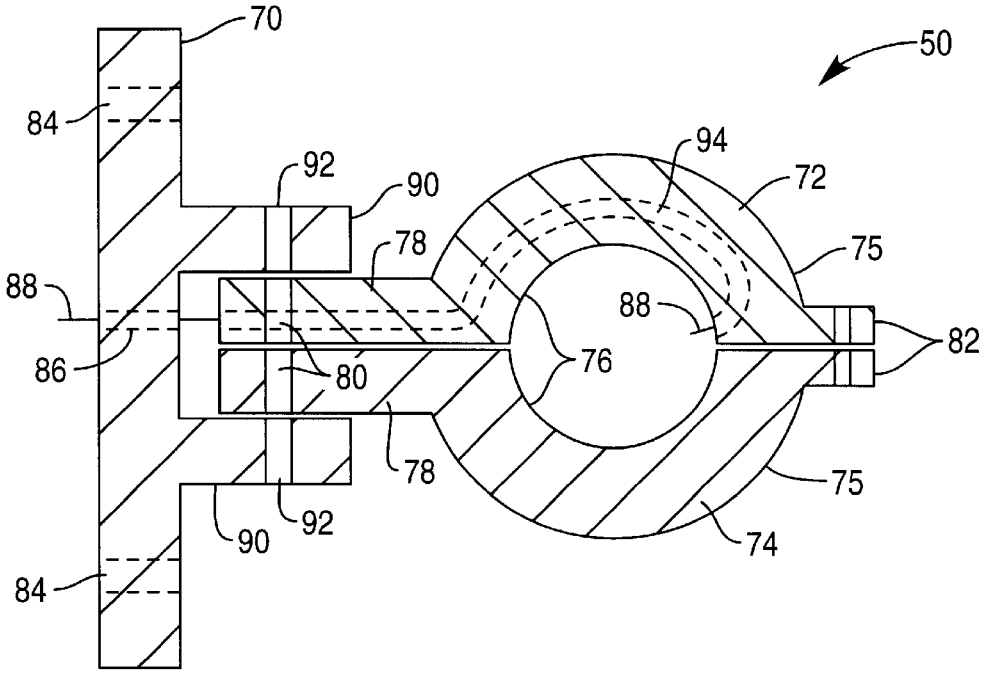
FIG. 4 is a cross-sectional plan view of the fixing bracket of FIG. 1.

Referring to FIG. 4, a cross-sectional plan view through a fixing bracket 50 is shown. The bracket 50 has three parts: a flange 70, and two clamping jaws 72,74.

Each clamping jaw 72,74 has a C-shaped end 75 having an internal surface 76 profiled to conform to the external surface 52 of the pole 14. Each jaw 72,74 also has a stem 78 extending from the C-shaped end 75. Each stem 78 has a bore 80. The C-shaped ends 75 also have apertured projections 82 for use in tightening the jaws 72,74 around the pole 14.

The flange 70 has fours bores 84 defined therein (only two are shown) which are used for coupling a module 40,42 to the flange 70. The flange 70 also has a channel 86 for routing electrical conductors 88 from a module coupled to the flange 70.

The flange 70 has two plates 90 projecting towards the jaws 72,74, each plate 90 having a bore 92 for aligning with bores 80.

Jaw 72 has a channel 94 for routing conductors 88 from bore 86 to internal surface 76, so that the conductors 88 are routed through the jaw 72.

When a module 40,42 is to be mounted onto the pole 14, it is first coupled to the flange 70. The electrical conductors 88 from the module 40,42 are routed through the channel 86 in the flange 70 and through the channel 94 in the jaw 72.

The conductors 88 are then inserted through an access slot 58 (FIG. 3) at or near to the desired height on the pole 14 by depressing the access cover 60 (FIG. 3) so that the electrical conductors 88 may be fed through the access slot 58 and down the bore 54 (FIG. 3) to connect to the central processor (not shown) in the enclosure 12.

The jaws 72,74 are then aligned and secured using a bolt through bores 80 and 92 and a bolt through apertured projections 82. The bolts are tightened to mount the bracket 50 securely to the pole 14.

The electrical conductors 88 which have been routed down the pole 14 may be connected to the central processor (not shown) so that the modules 40,42 mounted onto the pole 14 are in electrical communication with the central processor and any modules contained within the enclosure 12.

The embodiment of FIGS. 1 to 4 has the advantage that a module may be located at a number of different locations on the pole 14, so that each module is height-adjustable on the pole 14. Another advantage is that the module may be easily removed and replaced in the event of failure of that module.

Various changes may be made to the above described embodiments, within the scope of the invention. For example, the size and location of the access slots may vary. In some embodiments, the pole 14 may be designed so that only a single long access slot is used. In other embodiments, a bracket may have a ball joint between the flange and a module which is to be connected to the flange to allow the module to be rotated relative to the flange. In other embodiments, two or more columns may be used in each SST; or one column may be comprised of two or more column portions located on top of each other. A module may be located on top of one column portion and another column portion may be located on the top of that module.

Figure 5A:
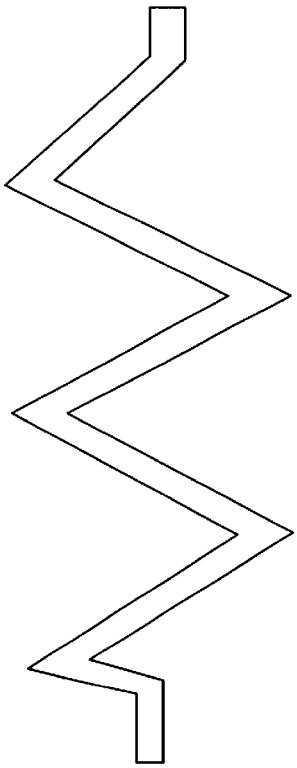
FIGS. 5*a,b* and *c* show different configurations of the column of FIG. 1.
Figure 5B:
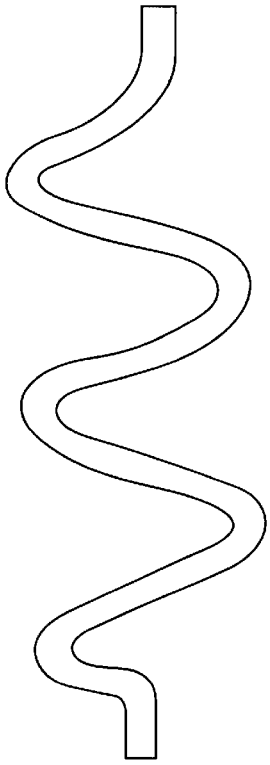
Figure 5C:
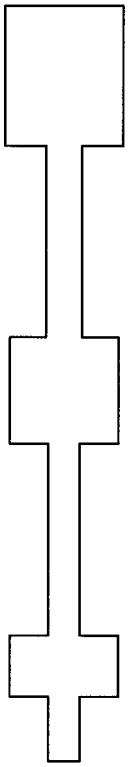

In other embodiments, the column may have a different shape. FIGS. 5*a* to *c* show front views of other possible configurations of the column. The column may be angular, as shown in FIG. 5*a*; curved, as shown in FIG. 5*b*; it may have a non-uniform cross-section, as shown in FIG. 5*c*. It will be appreciated that other shapes and configurations are possible.

Figure 6A:
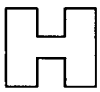
FIGS. 6*a,b* and *c* show different cross-sectional configurations of the column of FIG. 1.
Figure 6B:
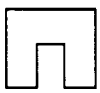
Figure 6C:
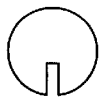

FIGS. 6*a* to *c* show plan views of other possible cross-sectional configurations of the column. The column may have an H-shaped cross-section (FIG. 6*a*); a U-shaped cross-section (FIG. 6*b*); or a or C-shaped cross-section (FIG. 6*c*); as will be appreciated, other cross-sectional configurations are possible.

In other embodiments, a jack may be located within the enclosure so that the column may be raised or lowered by actuating the jack. In this embodiment, the modules may be fixed at one position on the column and the column height may be adjusted. In other embodiments, the column may be secured to the enclosure using a friction mount which allows the column to be tilted towards or away from the front of the ATM. In other embodiments, a kiosk may be used instead of an ATM.

What is claimed is:

1. A self-service terminal having at least one externally mounted module which can be readily removed if it malfunctions, the self-service terminal comprising:

a first external module;

a base having a security enclosure for securely housing a central controller for controlling the operation of the self-service terminal;

an external column extending upwardly from the base on which the first external module can be independently mounted, the column having a bore through which electrical connections can be routed from the first external module to the base so that the first external module is electrically connected to the central controller;

a plurality of access slots through the external column allowing electrical conductors to be passed therethrough at different heights above the base; and a first connector for enabling the first external module to be removably mounted on the external column adjacent to a particular one of the plurality of access slots whereby the first external module's height above the base can be user selectable, the first connector comprises a first and second clamping jaw each having a C-shaped end and a stem, the stem of the first clamping jaw having a bore vertically aligned with a bore of the stem on the second clamping jaw, the first clamping jaw having a channel through which electrical conductors are routed and protected;

a flange having two parallel plates with bores vertically aligned; and a bolt threaded through the bores on the first clamping jaw, the second clamping jaw, and the two parallel plates.

2. A self-service terminal for facilitating a transaction with a user, the self-service terminal having at least one externally mounted module which can be readily removed if it malfunctions, the self-service terminal comprising:

a touch screen display module to be used by the user to interact with the self-service terminal;

a security enclosure for securely housing a central controller for controlling the operation of the self-service terminal and to restrict internal access to authorized personnel;

an external column extending upwardly from the security enclosure on which the touch screen display module is independently mounted, the column having a bore through which electrical connections can be routed from the touch screen display module to the security enclosure so that the touch screen display module is electrically connected to the central controller;

a plurality of access slots through the external column allowing electrical conductors to be passed therethrough at different heights above the security enclosure; and a first connector for enabling the touch screen display module to be removably mounted on the external column adjacent to a particular one of the plurality of access slots whereby the touch screen display module's height above the security enclosure can be selectable by authorized personnel;

wherein the touch screen display module is readily adjustable and readily removed without internal access to the security enclosure.

3. A terminal according to claim 2, further comprising:

a second external module mounted with a second connector on the external column so that the second external module is independently adjustable with respect to its height above the security enclosure, the second external module having electrical connections routed to the security enclosure through one of the plurality of access slots so that the second external module is electrically connected to the central controller.

4. A terminal according to claim 2, further comprising:

a light connected to the column to indicate operational service status of the terminal.

5. A terminal according to claim 2, further comprising:

a plurality of access covers to prevent ingress of contaminants into any of the plurality of access slots not having an attached external module; and means for urging each of said plurality of access covers to close over an associate unused access slot.

6. A terminal according to claim 2, further comprising:

means for adjustably raising and lowering the external column relative to the security enclosure.

7. A self-service terminal for facilitating a transaction with a user, the self-service terminal having at least one externally mounted module which can be readily removed if it malfunctions, the self-service terminal comprising:

a human iris recognition module to be used by the user to interact with the self-service terminal;

a security enclosure for securely housing a central controller for controlling the operation of the self-service terminal and to restrict internal access to authorized personnel;

an external column extending upwardly from the security enclosure on which the human iris recognition module is independently mounted, the column having a bore through which electrical connections can be routed from the human iris recognition module to the security-enclosure so that the human iris recognition module is electrically connected to the central controller;

a plurality of access slots through the external column allowing electrical conductors to be passed therethrough at different heights above the security enclosure; and a first connector for enabling the human iris recognition module to be removably mounted on the external column adjacent to a particular one of the plurality of access slots whereby the human iris recognition module's height above the security enclosure can be selectable by authorized personnel;

wherein the human iris recognition module is readily adjustable and readily removed without internal access to the security enclosure.

8. A terminal according to claim 7, further comprising:

a second external module mounted with a second connector on the external column so that the second external module is independently adjustable with respect to its height above the security enclosure, the second external module having electrical connections routed to the security enclosure through one of the plurality of access slots so that the second external module is electrically connected to the central controller.

9. A terminal according to claim 7, further comprising a light connected to the column to indicate operational service status of the terminal.

10. A terminal according to claim 7, further comprising:

a plurality of access covers to prevent ingress of contaminants into any of the plurality of access slots not having an attached external module; and means for urging each of said plurality of access covers to close over an associate unused access slot.

11. A terminal according to claim 7, further comprising means for adjustably raising and lowering the external column relative to the security enclosure.

12. An automated teller machine for facilitating a transaction with a user and easily maintained by authorized personnel, the automated teller machine comprising:

an external user interface module;

a security enclosure housing both a central controller for controlling the operation of the automated teller machine and a currency dispenser, the security enclosure restricting internal access to authorized personnel;

an external column extending outwardly from the security enclosure on which the plurality of modules are independently mounted, the column having a bore through which electrical connections can be routed from the external user interface module to the security enclosure so that the external user interface module is electrically connected to the central controller and a plurality of access slots through the external column allowing electrical conductors to be passed therethrough at different spacings from the security enclosure; and a plurality of connectors for enabling the plurality of modules to be mounted on the external column, each connector adjacent to a particular one of the plurality of access slots;

wherein the currency dispenser dispenses currency to a user in response to the user interacting with the external user interface module to request dispensing of currency and wherein the external user interface module is readily adjustable and readily removed without internal access to the security enclosure.

13. The automated teller machine according to claim 12, wherein the external column extends upwardly from the security enclosure.

14. The automated teller machine according to claim 12, wherein the external user interface module comprises a touch screen display module.

15. The automated teller machine according to claim 12, wherein the external user interface module comprises a human iris recognition scanner.

16. The automated teller machine according to claim 12, further comprising:

a light connected to the column to indicate operational service status of the terminal.

17. The automated teller machine according to claim 12, further comprising a means for adjustably raising and lowering the external column relative to the security enclosure.

18. The automated teller machine according to claim 12, further comprising a second external user interface module independently mounted on the external column with a second connector adjacent to a different one of the plurality of access slots.

* * * * *